US005639216A

United States Patent [19]

McLaurin et al.

[11] Patent Number: 5,639,216

[45] Date of Patent: Jun. 17, 1997

[54] GAS TURBINE BLADE WITH COOLED PLATFORM

[75] Inventors: Leroy D. McLaurin, Winter Springs; Barton M. Pepperman, Orlando, both of Fla.

[73] Assignee: Westinghouse Electric Corporation, Pittsburgh, Pa.

[21] Appl. No.: 606,909

[22] Filed: Feb. 26, 1996

Related U.S. Application Data

[63] Continuation of Ser. No. 299,169, Aug. 24, 1994, abandoned.

[51] Int. Cl.[6] ..... F01D 5/08

[52] U.S. Cl. ..... 416/95; 416/96 R

[58] Field of Search ..... 415/115, 116; 416/95, 96 R

[56] References Cited

U.S. PATENT DOCUMENTS

| | | | |
|---|---|---|---|
| 3,853,425 | 12/1974 | Scalzo et al. | 416/95 |
| 4,573,866 | 3/1986 | Sandy, Jr. et al. | 415/116 |
| 4,702,670 | 10/1987 | Winter | 415/115 |
| 4,726,735 | 2/1988 | Field et al. | 415/115 |
| 4,893,983 | 1/1990 | McGreehan | 415/116 |
| 5,003,773 | 4/1991 | Beckwith | 415/116 |
| 5,197,852 | 3/1993 | Walker et al. | 415/115 |
| 5,344,283 | 9/1994 | Magowan et al. | 415/115 |
| 5,413,458 | 5/1995 | Calderbank | 415/115 |

FOREIGN PATENT DOCUMENTS

| | | |
|---|---|---|
| 241739 | 9/1979 | France . |
| 2712629 | 5/1995 | France . |
| 161297 | 8/1969 | United Kingdom . |
| 2021699 | 12/1979 | United Kingdom . |
| 2057573 | 1/1981 | United Kingdom . |
| WO94/17285 | 4/1994 | WIPO . |

OTHER PUBLICATIONS

Patent Abstracts of Japan, vol. 013, No. 258 (M–838), Jun. 1989 & JP,A,01063605 (Hitachi Ltd) Mar. 1989.

*Primary Examiner*—John T. Kwon
*Attorney, Agent, or Firm*—M. G. Panian

[57] ABSTRACT

A turbine blade has a cooling air flow path specifically directed toward cooling the platform portion of the blade root. Two cooling air passages are formed in the blade root platform just below its upper surface. Each passage extends radially outward from an inlet that receives a flow of cooling air and then extend axially along almost the entire length of the platform. Each passage also has an outlet formed in the downstream face of the platform that allows the cooling air to exit the platform and enter the hot gas flow path. The passages are formed in portions of the platform that overhang the shank portion of root.

13 Claims, 5 Drawing Sheets

GAS TURBINE BLADE WITH COOLED PLATFORM

This application is a continuation of application Ser. No. 08/299,169 filed Aug. 24, 1994, abandoned.

BACKGROUND OF THE INVENTION

The present invention relates to the rotating blades of a gas turbine. More specifically, the present invention relates to a scheme for cooling the platform portion of a gas turbine blade.

A gas turbine is typically comprised of a compressor section that produces compressed air. Fuel is then mixed with and burned in a portion of this compressed air in one or more combustors, thereby producing a hot compressed gas. The hot compressed gas is then expanded in a turbine section to produce rotating shaft power.

The turbine section typically employs a plurality of alternating rows of stationary vanes and rotating blades. Each of the rotating blades has an airfoil portion and a root portion by which it is affixed to a rotor. The root portion includes a platform from which the airfoil portion extends.

Since the vanes and blades are exposed to the hot gas discharging from the combustors, cooling these components is of the utmost importance. Traditionally, cooling is accomplished by extracting a portion of the compressed air from the compressor, which may or may not then be cooled, and directing it to the turbine section, thereby bypassing the combustors. After introduction into the turbine, the cooling air flows through radial passages formed in the airfoil portions of the vanes and blades. Typically, a number of small axial passages are formed inside the vane and blade airfoils that connect with one or more of the radial passages so that cooling air is directed over the surfaces of the airfoils, such as the leading and trailing edges or the suction and pressure surfaces. After the cooling air exits the vane or blade it enters and mixes with the hot gas flowing through the turbine section.

Although the approach to blade cooling discussed above provides adequate cooling for the airfoil portions of the blades, traditionally, no cooling air was specifically designated for use in cooling the blade root platforms, the upper surfaces of which are exposed to the flow of hot gas from the combustors. Although a portion of the cooling air discharged from the upstream vanes flowed over the upper surfaces of the blade root platforms, so as to provide a measure of film cooling, experience has shown that this film cooling is insufficient to adequately cool the platforms. As a result, oxidation and cracking can occur in the platforms.

One possible solution is to increase the film cooling by increasing the amount of cooling air discharged from the upstream vanes. However, although such cooling air enters the hot gas flowing through the turbine section, little useful work is obtained from the cooling air since it was not subject to heat up in the combustion section. Thus, to achieve high efficiency, it is crucial that the use of cooling air be kept to a minimum.

It is therefore desirable to provide a scheme for cooling the platform portions of the rotating blades in a gas turbine using a minimum of cooling air.

SUMMARY OF THE INVENTION

Accordingly, it is the general object of the current invention to provide a scheme for cooling the platform portions of the rotating blades in a gas turbine using a minimum of cooling air.

Briefly, this object, as well as other objects of the current invention, is accomplished in a gas turbine comprising (i) a compressor section for producing compressed air, (ii) a combustion section for heating a first portion of the compressed air, thereby producing a hot compressed gas, (iii) a turbine section for expanding the hot compressed gas, the turbine section having a rotor disposed therein, the rotor having a plurality of blades attached thereto, each of the blades having an airfoil portion and a root portion, the root portion having a platform from which the airfoil extends; and (iv) means for cooling the blade root platform by directing a second portion of the compressed air from the compressor section to flow through the platform.

In one embodiment of the invention, the blade root platform cooling means comprises first and second approximately axially extending cooling air passages formed in the blade root platform.

DESCRIPTION OF THE PREFERRED EMBODIMENT

Figure 1:
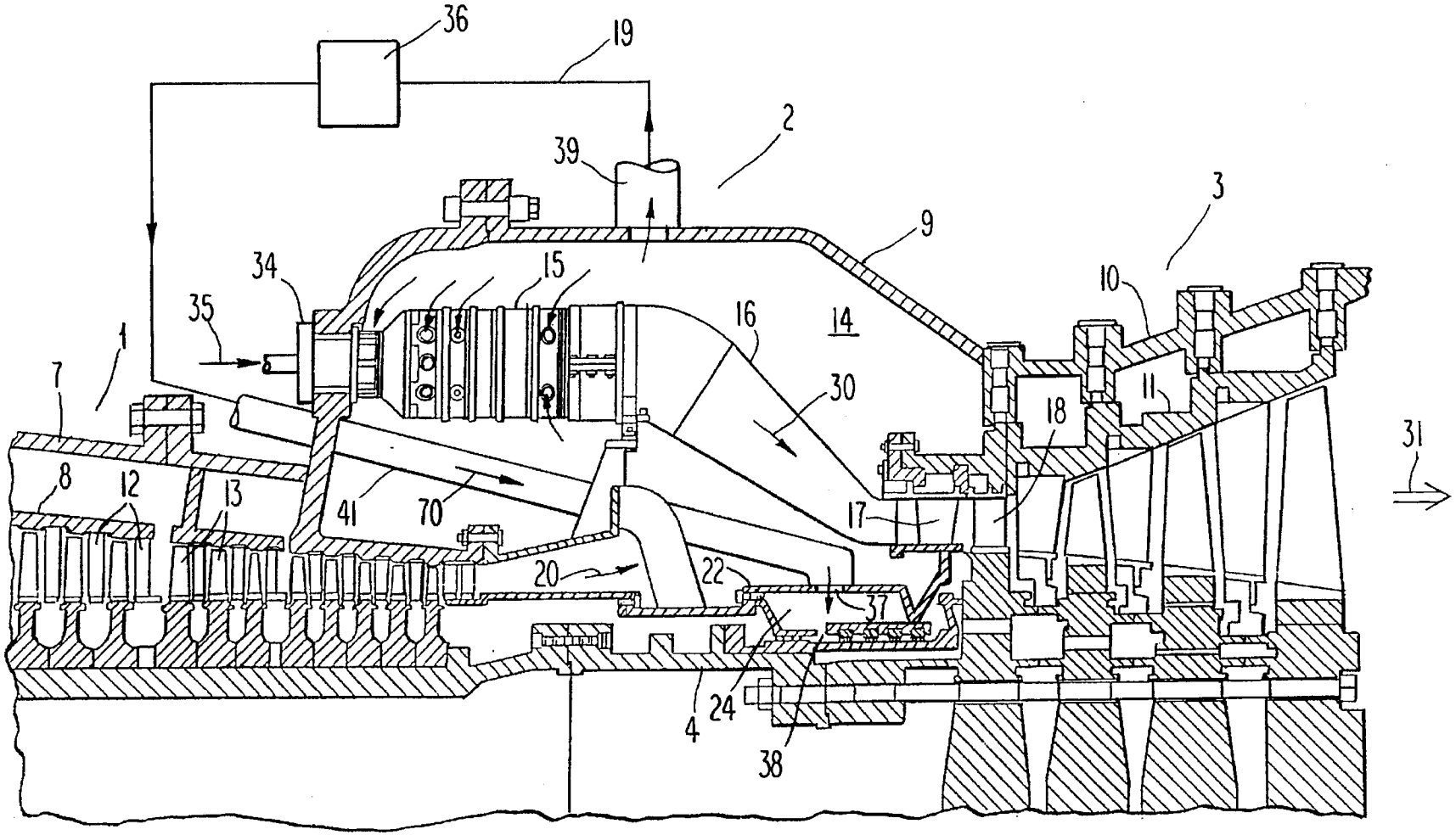
FIG. 1 is a longitudinal cross-section, partially schematic, through a portion of the gas turbine according to the current invention.

Referring to the drawings, there is shown in FIG. 1 a longitudinal cross-section through a portion of a gas turbine. The major components of the gas turbine are a compressor section 1, a combustion section 2, and a turbine section 3. As can be seen, a rotor 4 is centrally disposed and extends through the three sections. The compressor section 1 is comprised of cylinders 7 and 8 that enclose alternating rows of stationary vanes 12 and rotating blades 13. The stationary vanes 12 are affixed to the cylinder 8 and the rotating blades 13 are affixed to discs attached to the rotor 4.

The combustion section 2 is comprised of an approximately cylindrical shell 9 that forms a chamber 14, together with the aft end of the cylinder 8 and a housing 22 that encircles a portion of the rotor 4. A plurality of combustors 15 and ducts 16 are contained within the chamber 14. The ducts 16 connect the combustors 15 to the turbine section 3. Fuel 35, which may be in liquid or gaseous form—such as distillate oil or natural gas—enters each combustor 15 through a fuel nozzle 34 and is burned therein so as to form a hot compressed gas 30.

The turbine section 3 is comprised of an outer cylinder 10 that encloses an inner cylinder 11. The inner cylinder 11 encloses rows of stationary vanes 17 and rows of rotating blades 18. The stationary vanes 17 are affixed to the inner cylinder 11 and the rotating blades 18 are affixed to discs that form a portion of the turbine section of the rotor 4.

In operation, the compressor section 1 inducts ambient air and compresses it. The compressed air 20 from the compressor section 1 enters the chamber 14 and is then distributed to each of the combustors 15. In the combustors 15, the fuel 35 is mixed with the compressed air and burned, thereby forming the hot compressed gas 30. The hot compressed gas 30 flows through the ducts 16 and then through the rows of stationary vanes 17 and rotating blades 18 in the turbine section 3, wherein the gas expands and generates power that drives the rotor 4. The expanded gas 31 is then exhausted from the turbine 3.

A portion 19 of the compressed air 20 from the compressor 1 is extracted from the chamber 14 by means of a pipe 39 connected to the shell 9. Consequently, the compressed air 19 bypasses the combustors 15 and forms cooling air for the rotor 4. If desired, the cooling air 19 may be cooled by an external cooler 36. From the cooler 36, the cooled cooling air 70 is then directed to the turbine section 3 by means of a pipe 41. The pipe 41 directs the cooling air 70 to openings 37 formed in the housing 22, thereby allowing it to enter a cooling air manifold 24 that encircles the rotor 4.

Figure 2:
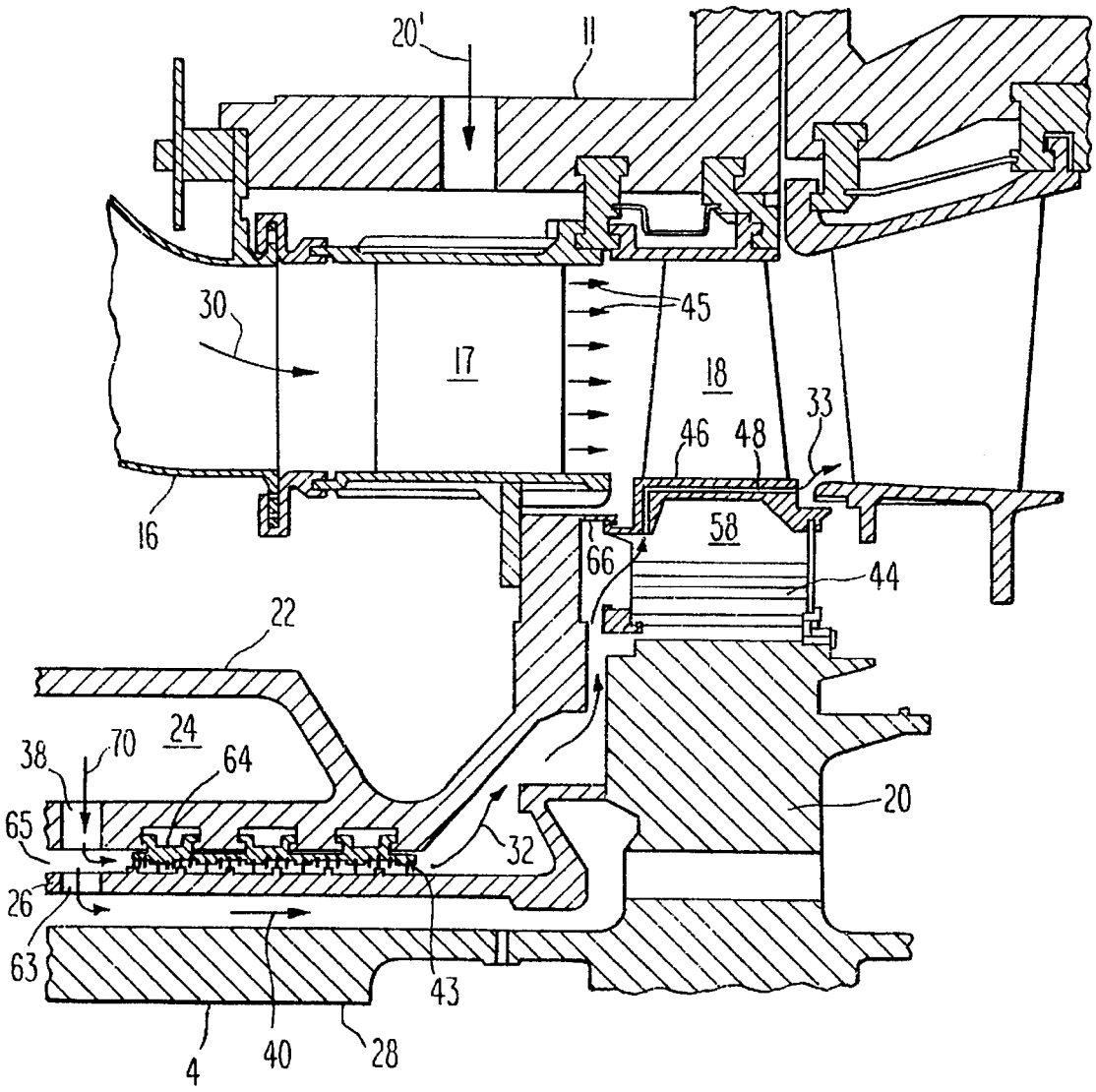
FIG. 2 is a detailed view of the portion of the turbine section shown in FIG. 1 in the vicinity of the first row blade.

As shown in FIG. 2, in the turbine section 3, the hot compressed gas 30 from the combustion section 2 flows first over the airfoil portion of the first stage vanes 17. A portion of the compressed air 20' from the compressor 1 flows through the first stage vane airfoil for cooling thereof. A plurality of holes (not shown) in the first stage vane airfoil discharges the cooling air 20' as a plurality of small streams 45 that are then mixed into the hot gas 30. The mixture of the cooling air 45 and the hot gas 30 then flows over the airfoil portion of the first row of blades 18.

Although, as previously discussed, the radially innermost of the streams 45 of cooling air from the first stage vane 17 can be expected to provide a certain amount of film cooling of the row one blade platform experience has shown that this cooling means is insufficient. Consequently, the current invention is directed to a scheme for providing additional cooling of the platform 48.

As shown in FIG. 2, the rotor cooling air 70 exits the cavity 24 via circumferential slots 38 in the housing 22, whereupon it enters an annular passage 65 formed between the housing 22 and a portion 26 of the rotor that is typically referred to as the "air separator." From the annular passage 65, the majority 40 of the cooling air 70 enters the air separator 26 via holes 63 and forms the cooling air that eventually finds its way to the rotor disc 20 and then to the various rows of blades.

A smaller portion 32 of the cooling air 70 flows downstream through the passage 65, over a number of labyrinth seals 64. From the passage 65 the cooling air 32 then flows radially outward. A honeycomb seal 66 is formed between the housing 22 and a forwardly extending lip of the row one blade 18. The seal 66 prevents the cooling air 32 from exiting directly into the hot gas flow path. Instead, according to the current invention, the cooling air 32 flows through two passages, discussed in detail below, formed in the platform 48 of each row one blade 18, thereby cooling the platform and preventing deterioration due to excess temperatures, such as oxidation and cracking. After discharging from the platform cooling air passages, the spent cooling air 33 enters the hot gas 30 expanding through the turbine section 3.

Figure 3:
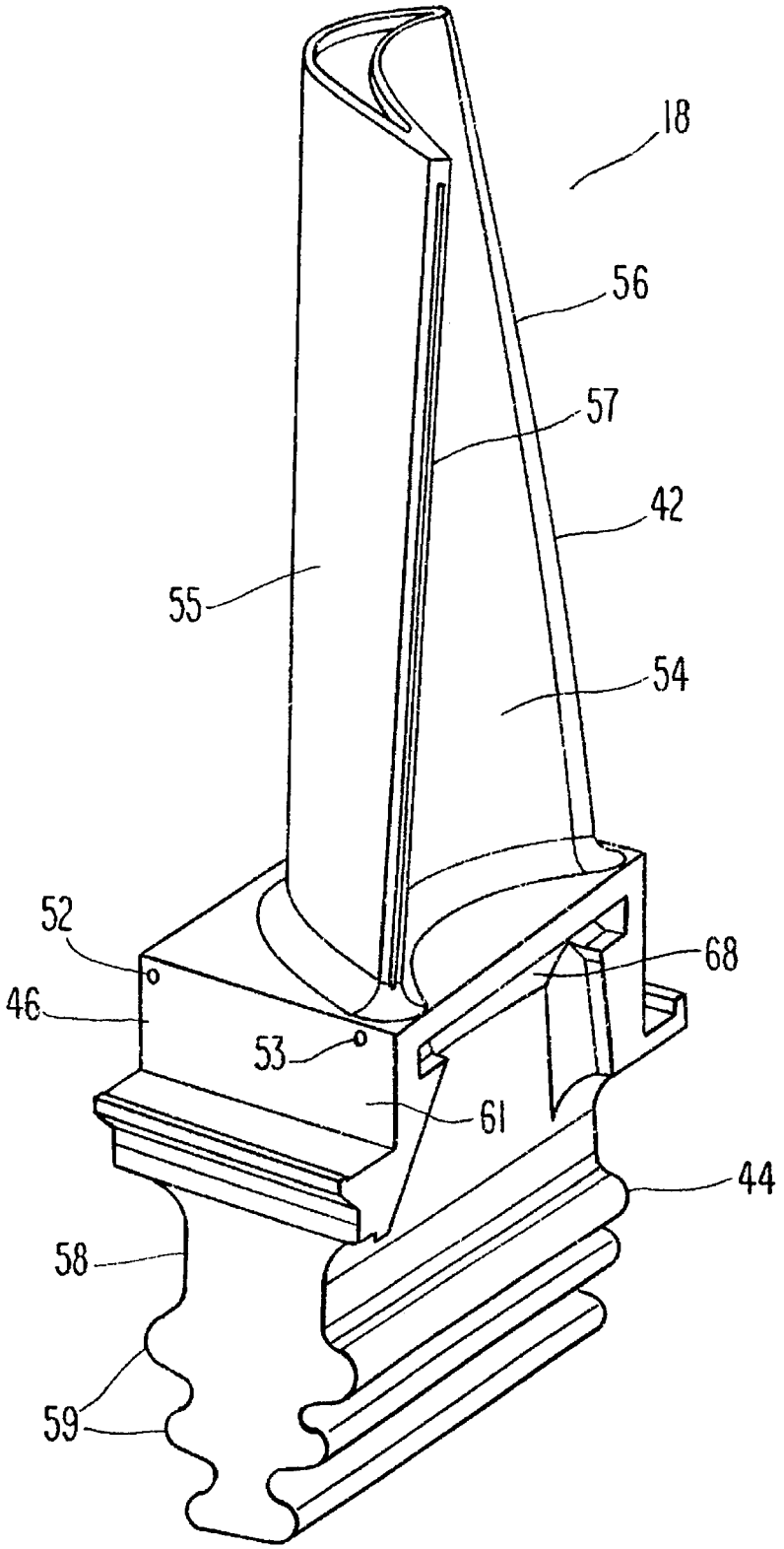
FIG. 3 is an isometric view, looking against the direction of flow, of the first row blade shown in FIG. 2.
Figure 4:
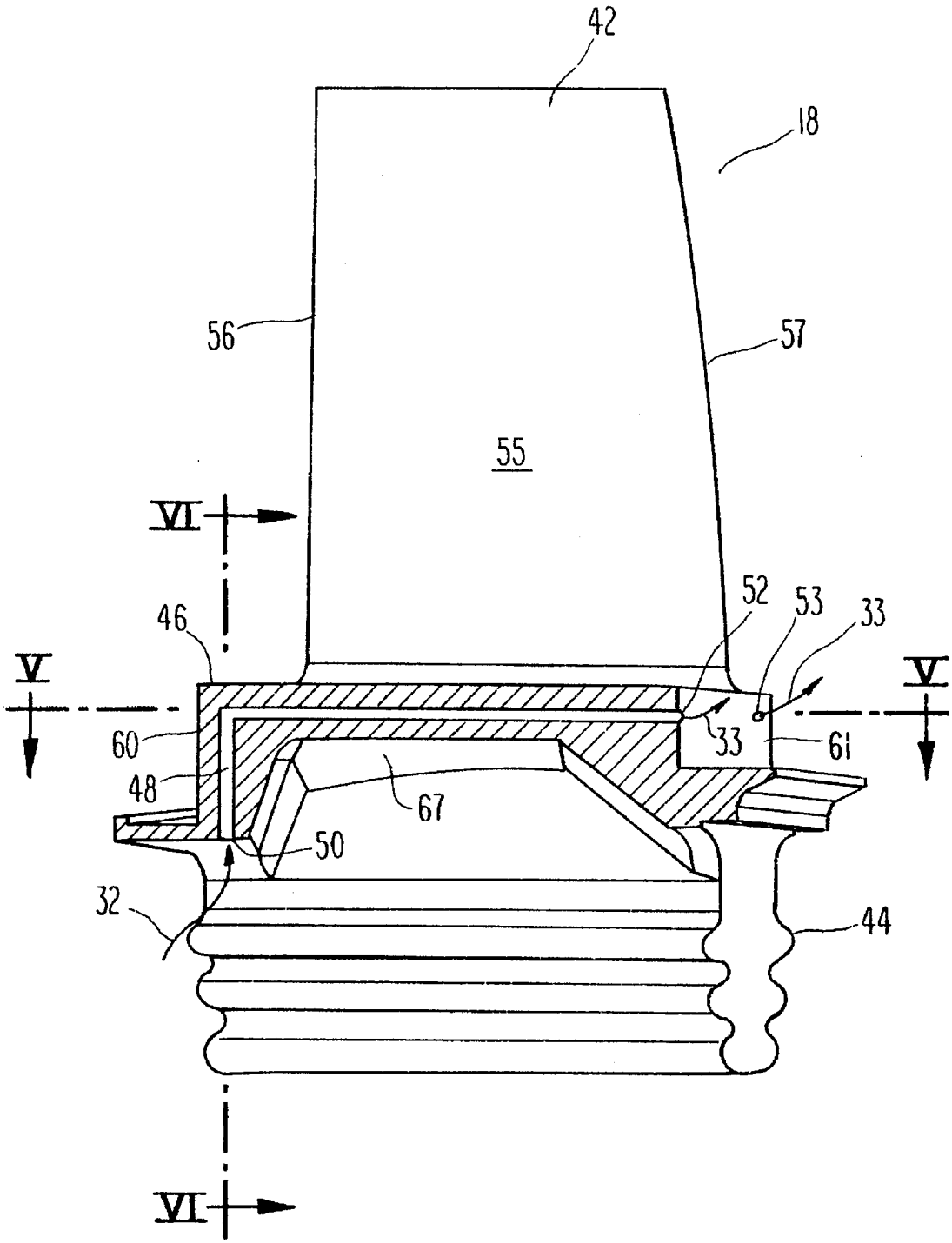
FIG. 4 is an elevation of the first row blade shown in FIG. 2, showing a cross-section through the platform section of the blade.

As shown in FIGS. 3 and 4, each row one turbine blade 18 is comprised of an airfoil portion 42 and a root portion 44. The airfoil portion 42 has a leading edge 56 and a trailing edge 57. A concave pressure surface 54 and a convex suction surface 55 extend between the leading and trailing edges 56 and 57 on opposing sides of the airfoil 42. The blade root 44 has a plurality of serrations 59 extending along its lower portion that engage with grooves formed in the rotor disc 20, thereby securing the blades to the disc. A platform portion 46 is formed at the upper portion of the blade root 44. The airfoil 42 is connected to, and extends radially outward from, the platform 46. A radially extending shank portion 58 connects the lower serrated portion of the blade root 44 with the platform 46.

Figure 5:
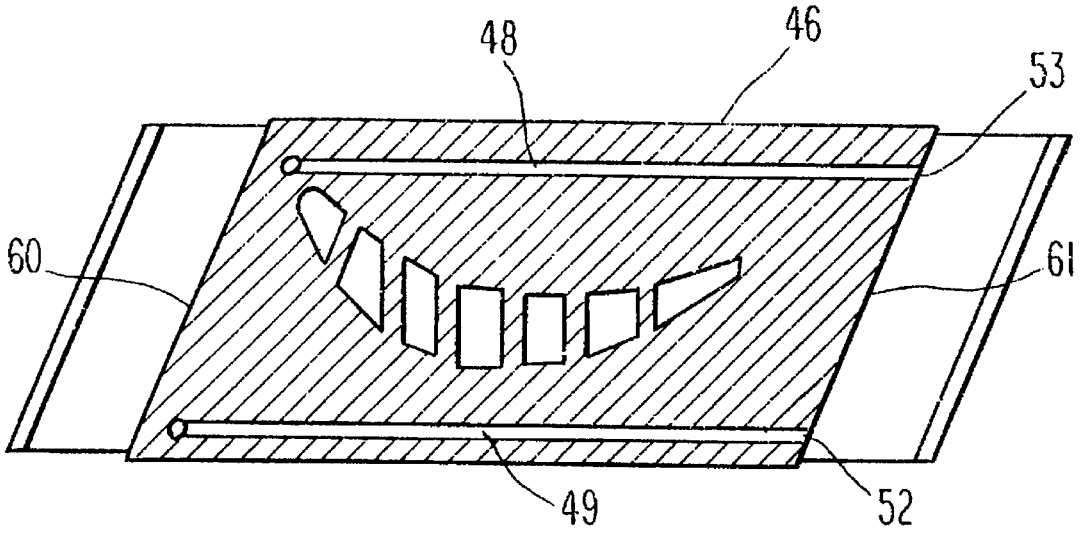
FIG. 5 is a cross-section taken through line V—V shown in FIG. 4.
Figure 6:
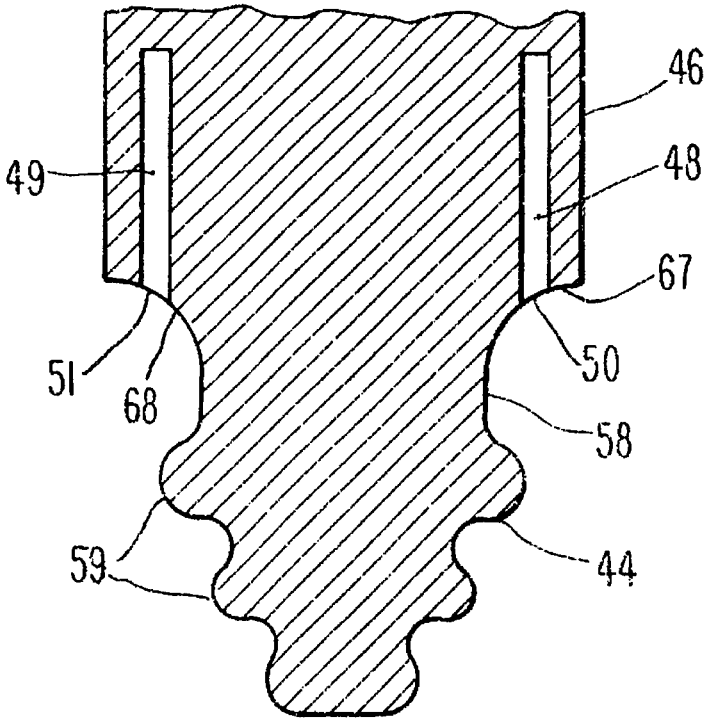
FIG. 6 is a cross-section taken through line VI—VI shown in FIG. 4.

As shown in FIGS. 3–5, the platform 46 has radially extending upstream and downstream faces 60 and 61, respectively. In addition, as shown best in FIGS. 4 and 6, a first portion 67 of the platform 46 extends transversely so as to overhang the shank 58 opposite the suction surface 55 of the blade airfoil 42. A second portion 68 of the platform 46 extends transversely so as to overhang the shank 58 opposite the pressure surface 54 of the blade airfoil 42. As shown in FIGS. 4–6, first and second cooling air passages 48 and 49, respectively, are formed in the overhanging portions 67 and 68 of the platform 46 just below its upper surface, which is exposed to the hot gas 30.

Each cooling air passage 48 and 49 has a radially extending portion that is connected to an axially extending portion. The axially extending portion of each of the cooling air passages 48 and 49 spans at least 50% of the axial length of the platform 46, and preferably spans almost the entire axial length of the platform. Preferably, the axial portion of the cooling air passages are located no more than 1.3 cm (0.5 inch), and most preferably no more than about 0.7 cm (0.27 inch) below the upper surface of the platform 46. As a result of the shape of the passages 48 and 49, the cooling air 32 makes a 90° turn from initially flowing radially outward to flowing axially downstream. In so doing, the cooling air flows axially along almost the entire length of the platform As shown best in FIG. 6, each of the cooling air passages 48 and 49 has an inlet 50 and 51, respectively, formed in a downward facing surface of the platform 46. The inlets 50 and 51 receive the radially upward flow of cooling air 32 from the passage 65. In addition, each of the cooling passages 48 and 49 has an outlet 52 and 53, respectively, formed on the downstream face 61 of the platform 46. The outlets 52 and 53 allow the spent cooling air 33 to exit the platform and enter the hot gas flow.

As can be seen, the cooling passages 48 and 49 provide vigorous cooling of the blade root platform 46 without the use of large quantities of cooling air, such as would be the case if the increased cooling were attempted by increasing the film cooling by increasing the flow rate of the innermost stream of the cooling air 45 discharged from the row one vane 17.

Although the present invention has been described with reference to the first row blade, the invention is also applicable to other blade rows. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A gas turbine comprising:

a) a compressor section for producing compressed air;

b) a combustion section for heating a first portion of said compressed air, thereby producing a hot compressed gas;

c) a turbine section for expanding said hot compressed gas, said turbine section having a rotor disposed therein, said rotor having a plurality of blades attached thereto, each of said blades having an airfoil portion and a root portion, said root portion having a platform from which said airfoil extends and a radially extending shank portion connected to said platform, a portion of said platform extending transversely beyond said shank portion, said platform further having a first approximately axially extending cooling air passage disposed in said transversely extending portion; and d) means for cooling said blade root platform by directing a second portion of said compressed air from said compressor section to flow through said first approximately axially extending cooling air passage of said platform.

2. The gas turbine according to claim 1, wherein:

a) each of said blade airfoils has a suction surface and a pressure surface;

b) said first approximately axially extending cooling air passage is disposed opposite said suction surface.

3. The gas turbine according to claim 1, wherein:

a) each of said blade airfoils has a suction surface and a pressure surface;

b) said first approximately axially extending cooling air passage is disposed opposite said pressure surface.

4. The gas turbine according to claim 3, wherein said blade platform cooling means comprises a second approximately axially extending cooling air passage formed in said blade root platform and disposed opposite said suction surface.

5. The gas turbine according to claim 1, wherein said blade root platform has upstream and downstream faces, said first approximately axially extending cooling air passage having an outlet formed in said downstream face.

6. The gas turbine according to claim 1, wherein said means for cooling said blade root platform further comprises an approximately radially extending cooling air passage connected to said first approximately axially extending cooling air passage.

7. The gas turbine according to claim 6, wherein said approximately radially extending cooling air passage has an inlet for receiving said second portion of said compressed air.

8. The gas turbine according to claim 1, wherein said means for cooling said blade root platform further comprises means for directing said second portion of said compressed air to said first approximately axially extending passage.

9. The gas turbine according to claim 8, further comprising a housing enclosing at least a portion of said rotor, and wherein said means for directing said second portion of said compressed air to said first approximately axially extending passage comprises an annular passage formed between said housing and said rotor.

10. In a gas turbine having (i) a compressor section for producing compressed air, (ii) a combustion section for heating a first portion of said compressed air, thereby producing a hot compressed gas, and (iii) a turbine section having a rotor disposed therein for expanding said hot compressed gas, a turbine blade comprising:

a) an airfoil portion having a suction surface and a pressure surface;

b) a root portion having (i) means for affixing said blade to said rotor, (ii) a platform from which said airfoil extends, and (iii) a shank portion, said platform having a first approximately axially extending cooling air passage formed therein and a first portion of said platform being disposed opposite said suction surface and overhangs said shank portion, said first approximately axially extending cooling air passage is formed in said first portion of said platform.

11. The turbine blade according to claim 10, wherein:

a) said platform has a second axially extending cooling air passage formed therein;

b) a second portion of said platform is disposed opposite said pressure surface and overhangs said shank portion, said second approximately extending cooling air passage formed in said second portion of said platform.

12. The turbine blade according to claim 10, wherein said platform has upstream and downstream faces, said first approximately axially extending cooling air passage having an outlet formed in said downstream face.

13. The turbine blade according to claim 10, wherein said blade root platform further comprises an approximately radially extending cooling air passage connected to said approximately axially extending cooling air passage.

* * * * *